United States Patent [19]

Stone

[11] 4,418,818

[45] Dec. 6, 1983

[54] BASKET CARRIER FOR BOTTLES HAVING TRANSVERSE DIVIDERS INSERTED THROUGH THE BOTTOM WALL

[75] Inventor: Orison W. Stone, Middlebury, Vt.

[73] Assignee: Pack Image, Inc., Middlebury, Vt.

[21] Appl. No.: 410,824

[22] Filed: Aug. 23, 1982

[51] Int. Cl.[3] ..... C23F 13/00

[52] U.S. Cl. ..... 206/196; 206/427; 229/28 BC; 229/52 BC

[58] Field of Search ..... 206/146, 147, 162, 165, 206/172, 177, 179, 184, 187, 189, 200, 427, 196, 197; 229/52 BC, 28 BC, 29 E, 29 F

[56] References Cited

U.S. PATENT DOCUMENTS

| | | | |
|---|---|---|---|
| 2,368,015 | 1/1945 | Gibson | 206/427 |
| 2,398,166 | 4/1946 | Struensee | 206/427 |
| 2,576,179 | 11/1951 | Holy | 206/172 |
| 2,664,235 | 12/1953 | Champlin et al. | 229/28 BC |
| 2,665,049 | 1/1954 | George | 206/200 |
| 2,687,067 | 8/1954 | Arneson . | |
| 2,773,625 | 12/1956 | Arneson . | |
| 2,811,279 | 10/1957 | Arneson . | |
| 2,812,878 | 11/1957 | Deeren et al. | 206/28 BC |
| 2,919,050 | 12/1959 | Arneson . | |
| 2,983,406 | 5/1961 | Arneson . | |
| 3,174,259 | 3/1965 | Jones et al. . | |
| 3,225,510 | 12/1965 | Jones et al. . | |
| 3,402,849 | 9/1968 | Matthews et al. | 206/189 |
| 4,234,081 | 11/1980 | Champlin | 229/28 BC |
| 4,240,546 | 12/1980 | Stone . | |
| 4,284,195 | 8/1981 | Champlin | 206/165 |

*Primary Examiner*—Joseph Man-Fu Moy
*Assistant Examiner*—David Fidei
*Attorney, Agent, or Firm*—Wood, Herron & Evans

[57] ABSTRACT

A basket carrier having a bottom wall, opposed end walls, opposed side walls and a longitudinal central divider. A transverse slot is formed in the bottom wall. A U-shaped divider having vertical walls and a horizontal wall with a central crease in it is formed initially in a U-shape and thrust upwardly through a single slot in the bottom wall. When introduced, the horizontal wall spreads out to overlie a substantial portion of the bottom wall on each side of the slot where it is retained by the bottoms of bottles clamping it to the bottom wall on either side of the central divider.

8 Claims, 6 Drawing Figures

BASKET CARRIER FOR BOTTLES HAVING TRANSVERSE DIVIDERS INSERTED THROUGH THE BOTTOM WALL

This invention relates to a basket-type carrier, and more particularly, the invention relates to improvements in a transverse divider which separates the carrier into six bottle-receiving cells.

A carrier of the type to which the present invention is directed is shown in U.S. Pat. No. 4,240,546 and copending application Ser. No. 270,108, filed June 3, 1981. The carrier of the patent and application, respectively, has a bottom wall, opposed side walls, opposed end walls and a central longitudinal divider formed by pressing top panels hinged along one or two central creases downwardly into the carrier. That central divider also forms a handle for the carrier. Transverse dividers along with the central dividers create six bottle-receiving cells within the carrier. These dividers are hinged to the panels forming the end walls and are primarily designed to be thrust into position during the loading of bottles using side loading machinery of the type described in U.S. Pat. Nos. 3,174,259 and 3,225,510.

It has been an objective of the present invention to provide transverse dividers which can easily be mounted in the basket carrier and which do not require the movement of side-loaded bottles or complex machinery to swing them into position. A basket carrier having such dividers is well suited for use with machinery which loads the carrier by depositing the bottles vertically into the carrier.

This objective of the invention is attained in part by providing a divider which is U-shaped and is thrust into the carrier through its bottom wall.

It is known to provide dividers by thrusting a U-shaped element through the bottom wall. See Pat. Nos. 2,687,067, 2,773,625, 2,811,279, 2,919,050 and 2,983,406. These dividers are generally U-shaped having vertical walls and a horizontal bottom wall. They are thurst through two spaced slots in the bottom wall of the carrier with the horizontal bottom wall underlying the bottom wall of the carrier and the vertical walls projecting into the carrier to divide it into six cells. This type of divider structure has its disadvantages. Means must be provided to lock the divider into position, for otherwise the divider will have a tendency to fall out of the slots into which it was inserted. Usually the slots through which the dividers are thrust and somewhat of an odd shape. The removal of the board to create the slots is somewhat difficult to accomplish by mechanical means and tends to weaken the bottom of the carrier. Finally, the structure creates assembly problems in that mechanism must be provided to insert the two vertical walls reliably through the two slots.

It has been another objective of the invention to provide an improved divider instead into the bottom of the carrier. This objective of the invention is attained by providing a single central transverse slot in the bottom wall of the carrier and by providing a U-shaped transverse divider having a horizontal wall which is centrally creased. That divider is initially formed in a V shape, bringing the upper ends of the vertical walls close together to enable it to be thrust into the bottom of the carrier. The central divider has inverted V-shaped slots whose edges, if extended, would project through the slot in the bottom wall. Those edges provide guides for the introduction of the vertical walls into the carrier and the spreading of the vertical walls to a vertical attitude as the divider completes its thrust into the carrier. Once the carrier has been inserted, the resilience of the crease in the horizontal wall causes the horizontal wall to spread outwardly and overlie a substantial portion of the bottom wall of the carrier. The lateral edges of the horizontal wall have outwardly-projecting radiused portions which extend beyond the extremities of the slot through which the divider is projecting so that when the divider is in position, the radiused portions underlie the bottom wall.

The primary advantage of this structure is the ease with which it can be assembled simply by gripping the V-shaped bottom wall and thrusting the divider through the central slot. Additionally, the central slot, being rectangular, is more easily removed than the two odd-shaped slots and will normally cause the removal of less board from the bottom of the carrier than would be removed with prior constructions.

No special locking means are required to retain the divider since the engagement of the horizontal wall by the lower surface of the two bottles inserted in the central portion of the carrier will clamp the horizontal wall against the bottom wall of the carrier thus securely retaining it.

Another feature of the invention has been to provide a nesting relationship between opposed ends of the divider to permit the dividers to be cut more economically from board stock. Thus, the dividers can be cut from narrow roll of stock in end-to-end relationship without waste except for the V-shaped slots which must be formed to engage the central divider of the carrier. When inserted in the carrier and the bottles loaded, these dividers will be contacted with about four inches of the lower portion of each bottle contained within the carrier.

The several features and objectives of the present invention will become more readily apparent from the following detailed description taken in conjunction with the accompanying drawings in which.

Figure 1:
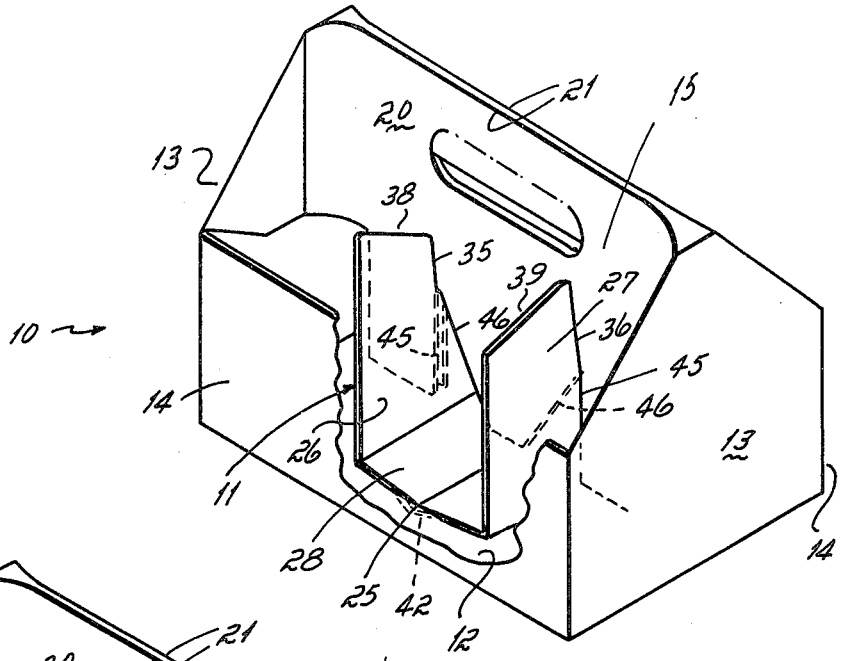
FIG. 1 is a perspective view, partially broken away, of a carrier embodying the present invention.

Referring to FIG. 1, the carrier is shown at 10 and has a divider 11 in the central portion of the carrier. The carrier has a bottom wall 12, two opposed end walls 13 and two opposed side walls 14. A central divider 15 is connected between the end walls 13 and is formed from two top wall panels 20 which are folded from a horizontal attitude down to a vertical attitude within the carrier along parallel creases 21. The bottom wall has a central slot 25 which is approximately 1.25 inches wide and 3.5 inches long. The central divider is generally U-shaped and has two vertical walls 26 and 27 which are connected to a horizontal wall 28 along two cut scores 29. The cut scores are formed on the underside of the divider and permit the walls to swing easily to a vertical attitude. The horizontal wall also has a central crease 30.

Figure 4:
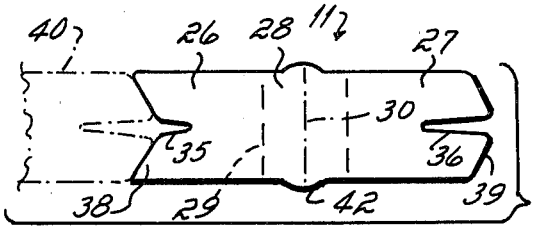
FIG. 4 is a plan view of a blank from which the transverse divider is formed.

The upper end portions of the walls 26 and 27 have V-shaped slots 35, 36. The upper edges 38, 39 (see FIGS. 2 and 4) have complimentary V-shaped configurations which permit the dividers to nest together, as shown by the phantom line 40 (FIG. 4), in an elongated, narrow roll of stock for economy in manufacturing the dividers.

The horizontal wall 28 has at its opposed edges a projecting radius 42. The width of the divider is slightly under 3.5 inches so that it will easily project through the slot. The dimension across the outermost points of the radii is slightly greater than $3\frac{5}{8}$ inches so that when the divider is inserted through the 3.5 inch slot 25, a small portion of each projecting radius will underlie the bottom wall 12 of the carrier.

Figure 6:
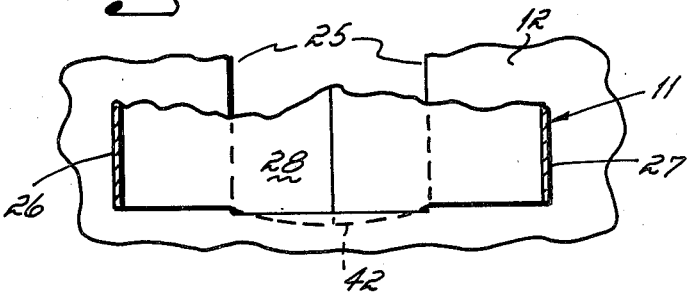
FIG. 6 is a cross-sectional view taken along lines 6—6 of FIG. 5 illustrating a portion of the divider overlying the bottom wall of the carrier.

The central divider 15 has two spaced inverted V-shaped slots 45. Those slots have adjacent edges 46 which are downwardly and inwardly inclined toward the slot 25 and would, if extended, pass through the slot 25. They thus form guides which are engageable by the slots 35 and 36 of the divider to slide the vertical walls of the divider into the proper position with the carrier so that they are vertical and spaced apart by approximately the diameter of a bottle 47 (FIG. 6).

Figure 2:
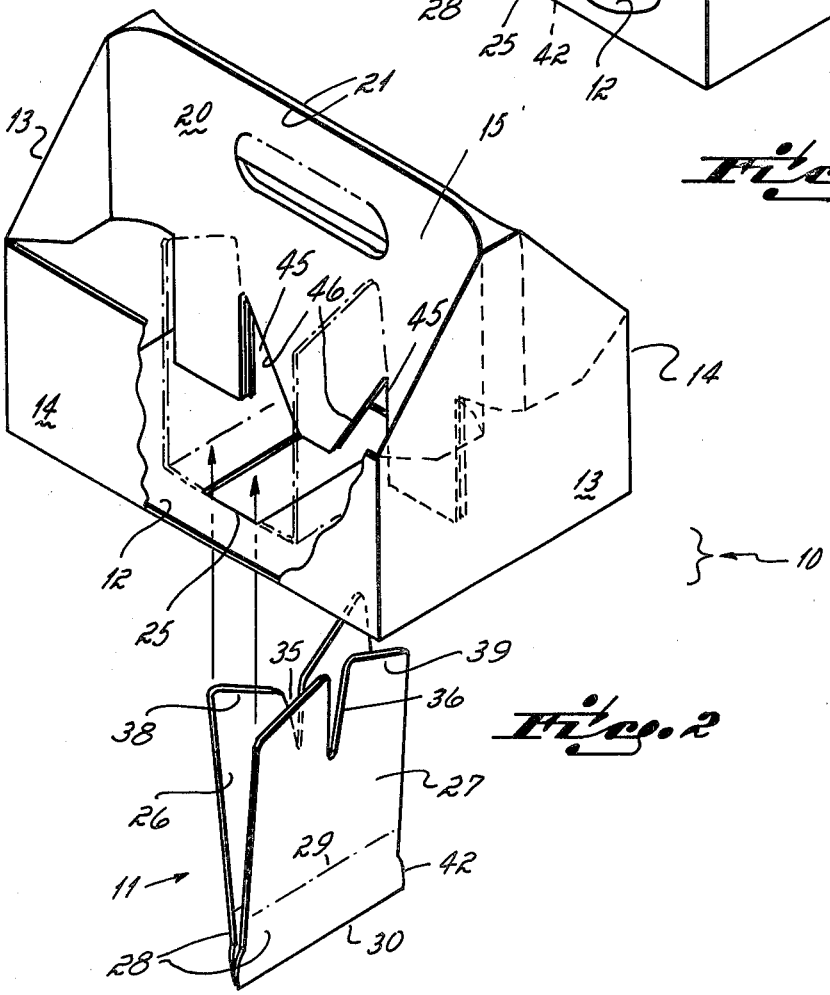
FIG. 2 is a disassembled perspective view similar to FIG. 1 illustrating the assembling of the transverse dividers.
Figure 3:
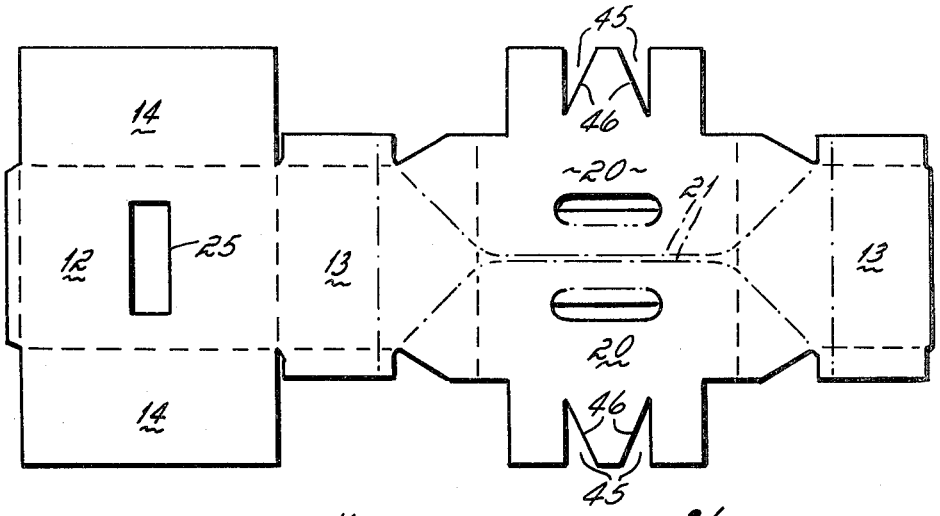
FIG. 3 is a plan view of a blank from which the carrier is formed.
Figure 5:
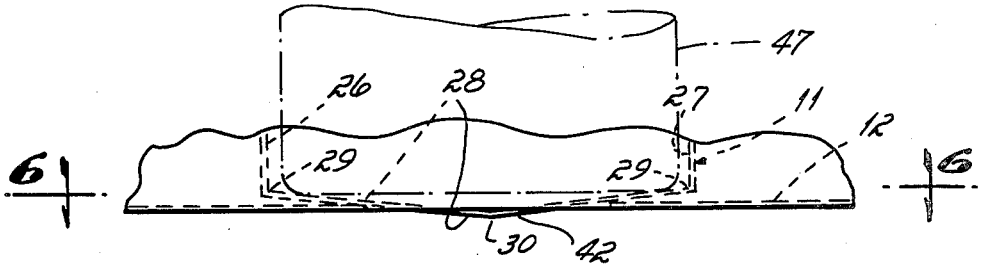
FIG. 5 is an end elevational view of the carrier.

The carrier is formed as follows: a one-piece blank is first cut, creased and scored as shown in FIG. 3. It is erected, folded and glued to the condition shown in FIG. 2. The central divider is folded on the crease 30 into a V-shape condition as shown in FIG. 2 wherein the upper edges 38 and 39 are spaced apart a distance less than the width of the slot 25. The divider may be held in this attitude by a simple element on the machine for erecting and assembling the carrier. In that condition, the divider is thrust upwardly through the slot 25 into the carrier. As the divider is thrust upwardly, the V-shaped slots 35, 36 of the vertical walls 26 and 27 ride on the edges 46 of the inverted V-shaped slots 45 of the central divider 15. As continued upward force on the horizontal wall 28 of the divider is exerted, the apices of the respective V's of transverse divider 11 and the central divider 15 move into engagement and the horizontal wall 28 snaps outwardly to overlie a substantial portion of the bottom wall 12 on either side of the slot 25 (FIGS. 5 and 6). The crease 30 retains the resilience to encourage the horizontal wall 28 to remain substantially flat while the cut scores 29 permit the vertical walls to assume a vertical attitude.

With the preferred dimensions, about $\frac{3}{4}$ inch of the horizontal wall 28 overlies each side of the slot. This single step completes the assembly of the transverse divider into the carrier. When bottles are deposited into the carrer, the bottom of each bottle will engage the horizontal wall of the transverse divider and clamp it against the bottom wall 12, on each side of slot 25, thereby preventing its inadvertent removal. As can be seen from FIGS. 1 and 5, the radiused portions 42 of the horizontal wall 28 underlie the carrier bottom wall 12 thus preventing an upward floating of the horizontal divider after it is inserted into the carrier.

In the preferred form of the invention, the transverse slot 25 is no wider than one-half the diameter of the bottle 47, and the horizontal wall 28 of the divider is not less than the diameter of the bottle 47 so that when the divider is in place, not less than one-half of the distance between the center crease 30 and the cut score 29 overlies the upper surface of the bottom wall on each side of said slot 25. By way of illustration, the diameter of the bottle 47 is $2\frac{3}{4}$ inches. The width of the slot is 1.25 inches and the length of the slot is 3.5 inches. The horizontal wall of the divider is about $2\frac{3}{4}$ inches wide. The portion of the slot overlying the bottom wall beyond the edges of the slot 25 is $\frac{3}{4}$ inch wide.

Having described my invention, I claim:

1. In a basket carrier for bottles and having a bottom wall, opposed end walls, opposed side walls and a central longitudinal divider, the improvement comprising a transverse divider structure comprising, a transverse slot formed across a major portion of said bottom wall, two inverted V-shaped slots in the lower portion of said central divider, a transverse divider element, said divider element being U-shaped and having vertical divider walls containing V-shaped slots which engage the central divider V-shaped slots to hold said divider walls in a vertical attitude, said transverse divider having a horizontal wall whose longitudinal dimension is substantially greater than the width of the slot in said bottom wall, said horizontal wall being transversely creased to permit the divider to be folded into a V for insertion into said carrier through said slot, after said transverse divider is inserted in said carrier, said horizontal wall spreads beyond said slot and a substantial portion of it overlies said bottom wall where it is retained by the weight of bottles on it.

2. A carrier as in claim 1 in which the central portion of said bottom wall has a transverse dimension greater than the length of said slot, thereby providing marginal portions underlying said bottom wall.

3. A carrier as in claims 1 or 2 in which said transverse slot is about 1.25 inches wide.

4. A carrier as in claims 1 or 2 in which said transverse slot is about 1.25 inches wide and said horizontal wall of said divider is about $2\frac{3}{4}$ inches wide, whereby about $\frac{3}{4}$ inch of said horizontal wall overlies the upper surface of said bottom wall on each side of said slot.

5. A carrier as in claim 1 in which said two inverted V-shaped slots in said central divider have adjacent edges which, if extended, would project through said slot in said bottom wall thereby forming guides for the introduction of said divider into the interior of said carrier.

6. A carrier as in claim 1 in which said transverse divider vertical walls are hinged to said horizontal wall along cut score lines which are spaced apart by about one bottle diameter.

7. A carrier as in claims 1 or 2 in which said transverse slot is no wider than one-half the bottom diameter.

8. A carrier as in claims 1 or 2 in which said transverse slot is no wider than one-half the bottle diameter and said horizontal wall of said divider is not less than the bottle diameter, whereby not less than one-half of the distance between the center crease and the cut scores overlies the upper surface of said bottom wall on each side of said slot.

* * * * *